US008036583B2

(12) United States Patent
Stelter

(10) Patent No.: US 8,036,583 B2
(45) Date of Patent: Oct. 11, 2011

(54) PREHEATING OF SUBSTRATES

(75) Inventor: Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 158 days.

(21) Appl. No.: 12/489,464

(22) Filed: Jun. 23, 2009

(65) Prior Publication Data

US 2010/0322680 A1 Dec. 23, 2010

(51) Int. Cl.
*G03G 15/20* (2006.01)

(52) U.S. Cl. ..... 399/336; 430/124.52

(58) Field of Classification Search ..... 399/320, 399/328, 335, 336; 219/216; 430/124.5, 430/124.52, 124.53
See application file for complete search history.

(56) References Cited

U.S. PATENT DOCUMENTS

| | | | | |
|---|---|---|---|---|
| RE28,802 | E * | 5/1976 | Draugelis et al. | 219/216 |
| 5,249,949 | A * | 10/1993 | Aslam et al. | 425/385 |
| 5,327,201 | A * | 7/1994 | Coleman et al. | 399/342 |
| 6,379,745 | B1 | 4/2002 | Kydd et al. | |
| 6,528,127 | B1 | 3/2003 | Edlein et al. | |
| 6,675,710 | B2 | 1/2004 | Friedman et al. | |
| 6,704,538 | B2 * | 3/2004 | Nakamura et al. | 399/336 |
| 7,184,698 | B2 * | 2/2007 | Tombs | 399/341 |
| 7,245,866 | B2 * | 7/2007 | Frohlich | 399/341 |
| 7,596,349 | B2 * | 9/2009 | Ishiduka | 399/341 |
| 2002/0037176 | A1 * | 3/2002 | Ogino et al. | 399/68 |
| 2007/0065187 | A1 * | 3/2007 | Kodera et al. | 399/307 |
| 2007/0281230 | A1 * | 12/2007 | Miyake et al. | 430/60 |
| 2009/0257773 | A1 * | 10/2009 | Barton et al. | 399/92 |

FOREIGN PATENT DOCUMENTS

| | | | |
|---|---|---|---|
| JP | 63231361 A | * | 9/1988 |
| JP | 06266145 A | * | 9/1994 |
| WO | WO 2010066267 A1 | * | 6/2010 |

* cited by examiner

*Primary Examiner* — Robert Beatty
(74) *Attorney, Agent, or Firm* — Donna P. Suchy; Christopher J. White

(57) ABSTRACT

An electrophotographic imaging apparatus is provided which is capable of performing a method of preparing a non-metal substrate. The method can include imaging at least one surface of the non-metal substrate with a toner composition, the toner composition including IR absorbers. The method can further include exposing the toner composition to IR radiation through the substrate, thereby pre-heating the toner composition and preheating the substrate to a temperature less than a glass transition temperature of the substrate. The method can further include fusing the pre-heated imaged non-metal substrate at a predetermined temperature so that the average temperature of the substrate during and after fusing is less than a glass transition temperature of the substrate.

2 Claims, 2 Drawing Sheets

PREHEATING OF SUBSTRATES

FIELD OF THE INVENTION

The invention relates to a method and apparatus for managing a non-metal substrate in an electrophotographic imaging apparatus. More particularly, the exemplary embodiments relate to preheating toner compositions imaged on non-metal substrates such as heat sensitive films, including transparent plastic films, prior to fusing in an electrophotographic imaging device.

BACKGROUND OF THE INVENTION

In known electrophotographic art, an electrostatically imaged metal printing plate can be prepared for imaging by preheating to a first temperature, and then heating to a second temperature, without developing an image between the heating steps. An example of this type of method can be found in U.S. Pat. No. 6,675,710, incorporated by reference in its entirety herein. This method is used to obtain an imaged element with adequate toner fusing while avoiding substrate buckling and distortion. Although certain methods are known for preparing an electrostatically imaged metal printing plate, such as the aluminum plate of the '710 patent, there are no corresponding methods for controlling a temperature of extremely heat sensitive substrates (e.g. non-metal substrates such as plastics used for labels) in electrophotographic devices or otherwise.

It is appreciated herein that a temperature of a metal printing plate can be relatively easy to control, unlike a non-metal, heat sensitive substrate. For example, metal has a small specific heat and high conductivity. This means that the temperature of a sheet of metal increases rapidly and relatively uniformly as heat is added, and it is therefore easy to control a fusing temperature at a fuser when using metal as a substrate. Metal substrates are also not extremely heat sensitive at the temperatures used for fusing toner images. However, for non-metallic substrates, the relative inability to heat a non-metal substrate quickly and uniformly can cause error and delay in reaching a fusing temperature at which a toner composition can be fused to the substrate, and allowing all fusing heat to be derived from the fuser can easily cause distortion and other degradation of the non-metal substrate. Further, relying on the fuser for all heat input to reach a fusing temperature can result in excessive heating for certain non-metal substrates, and early failure of the fuser apparatus.

It is now desirable to expand electrophotographic imaging to include a wide variety of substrate materials. Non-metal substrates can include heat sensitive materials. The heat sensitive materials can include heat sensitive films typically formed of flexible materials, including heat-shrink film. Imaged flexible materials can then be used in flexible displays, packaging, bottle labeling, container labeling, and the like. However, because of their flexible, thermosensitive nature, these non-metal substrates can be highly subject to distortion, tearing, buckling, degradation, etc. compared to metallic substrates or normal paper substrates.

In view of the foregoing, it would be advantageous to employ electrostatic imaging of a non-metal substrate in such a manner as to achieve adequate toner fusing and minimize or eliminate undesired buckling, distortion, and degradation of the non-metal substrate during fusing. Because fusing can be the speed-limiting step in an electrophotographic imaging device, an increase in speed at the fusing apparatus can improve an overall speed of the imaging device.

SUMMARY OF THE INVENTION

In accordance with the present teachings, a method of limiting a fusing temperature in an electrophotographic imaging apparatus is provided. In order to maintain and actually increase a speed of printing using a non-metal substrate in electrophotographic devices, only this inventor has recognized a need in the art to limit a fusing temperature by preheating a toner composition relative to the substrate, instead of preheating a substrate, thereby preventing distortion of the non-metal substrate at a fuser.

The exemplary method can include imaging at least one surface of the non-metal substrate with a toner composition, the toner composition comprising IR absorbers; exposing the toner composition to IR radiation through the substrate, thereby pre-heating the toner composition; and fusing the exposed toner composition to the non-metal substrate with the substrate at a predetermined temperature less than a glass transition temperature of the substrate. In a preferred embodiment, the exposed toner composition is pre-heated to a temperature less than a glass transition temperature of the toner composition. In accordance with the present teachings, an electrophotographic imaging apparatus is provided.

The exemplary apparatus can include a non-metal substrate imaged with a toner composition, the toner composition comprising IR absorbers; an exposing device positioned to expose the toner composition to IR radiation through the substrate, and a fusing device operable to fuse the pre-heated toner composition to the non-metal substrate at a predetermined temperature less than a glass transition temperature of the substrate. In a preferred embodiment, the exposed toner composition is pre-heated to a temperature less than a glass transition temperature of the toner composition and fused using a roller fuser.

The invention and its objects and advantages will become more apparent in the detailed description of the preferred embodiment presented below.

BRIEF DESCRIPTION OF THE DRAWINGS

The above and other objects, features, and advantages of the present invention will become more apparent when taken in conjunction with the following description and drawings, wherein identical reference numbers have been used, where possible, to designate identical features that are common to the figures, and wherein.

DETAILED DESCRIPTION OF THE INVENTION

Figure 1:
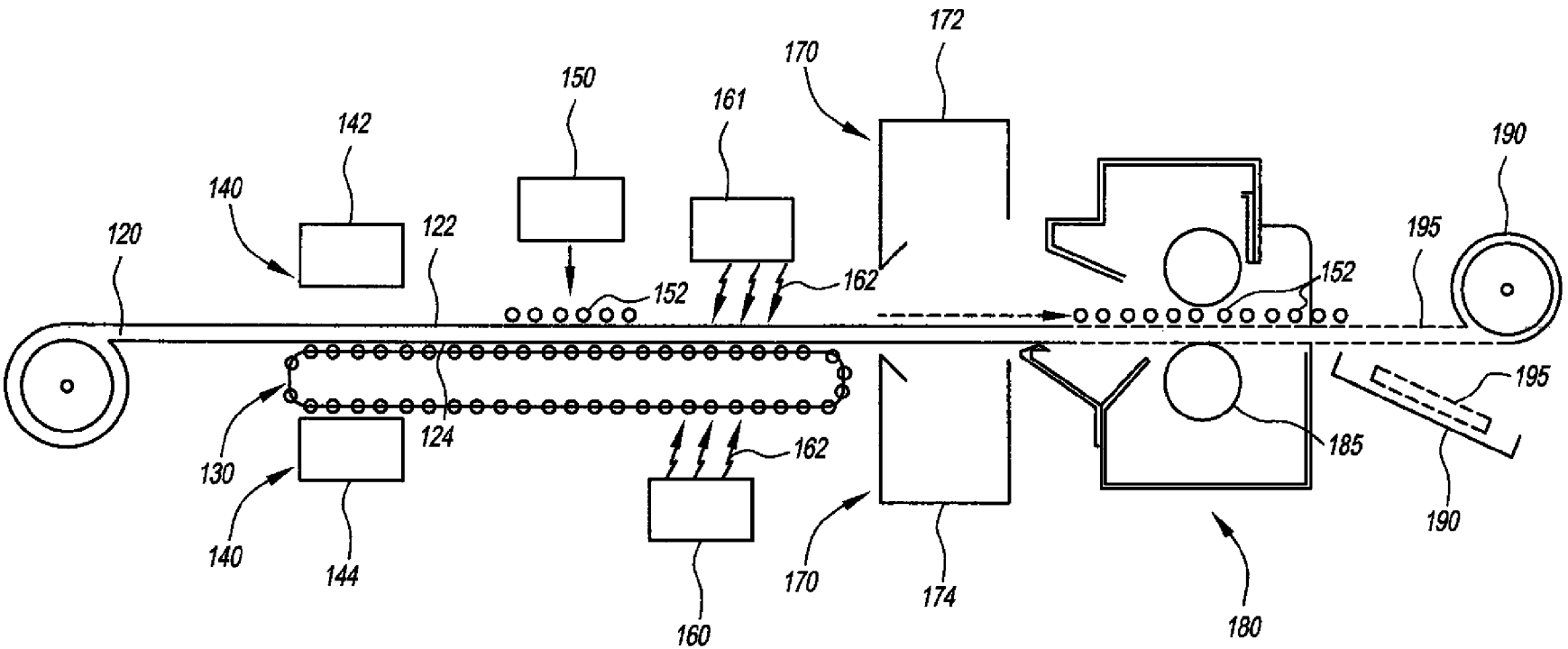
FIG. 1 schematically depicts the overall process configuration for the preparation of an imaged element on a non-metal substrate in accordance with this invention.

Reference will now be made in detail to exemplary embodiments of the invention, examples of which are illustrated in the accompanying drawings. However, one of ordinary skill in the art would readily recognize that the same principles are equally applicable to, and can be implemented in devices other than electrophotographic imaging devices, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents. Wherever possible, the same reference numbers will be used throughout the drawings to refer to the same or like parts.

As used herein, the terms "fuse", "fuser", "fused", and "fusing" refer to that portion of an electrophotographic imaging device in which a toner is fixed onto a substrate medium. The substrate medium can be any non-metallic receiver or other material that can be printed on, such as paper, plastic, and other materials. For example, this method is useful for printing on heat-sensitive materials such as label stock. Label stock materials include: Polyvinyl Chloride (PVC), Polypropylene Terephthalate Glycol (PETG), Oriented Polypropylene (OPP), Kimdura® Tyvek, or other synthetic papers, Polyethylene (PE), Polypropylene (PP), Polystyrene (PS), and/or High Density Polyethylene (HDPE). The substrate can be in web form, sheet form, and/or be in tube or sleeve form.

As used herein, the term "glass transition temperature" ($T_g$), is the temperature at which an amorphous solid, such as glass or a polymer, becomes brittle on cooling, or soft on heating.

As used herein, "electrophotographic imaging" is intended to include a printing technique using electrostatic charges, toner, and light. In simplified generalities, a photoconductive drum is positively charged. Using a laser or light emitting diodes (LEDs), a negative of an image is beamed onto the drum, cancelling the charge and leaving a positively charged replica of the original image. A negatively charged toner is attracted to the positive image on the drum. The toner is then attracted to the paper or substrate, which is also positively charged. A fusing stage uses heat and pressure, pressure alone, or light to cause the toner to permanently adhere to the substrate.

It will be understood by those skilled in the art that the purpose of the electrostatic imaging is to transfer a desired image and information contained therein from an information source (e.g. a computer or the like) to non-metal substrate by digital or analog means for inclusion in the non-metal substrate of this invention.

Conventional toner compositions, as are well known in the art, may be used to image the non-metal substrate. Toner compositions suitable for use in photocopiers, laser printers and the like are suitable for use as the toner composition in the exemplary embodiments and are preferred. In one embodiment of this invention, the toner composition used can include a photocopier toner comprising carbon black surrounded by a layer of styrene-acrylic or styrene-butadiene resin, and the toner composition has a glass transition temperature ($T_g$) in the range of about 70 to about 90° C. In another exemplary embodiment, cyan toner compositions can comprise a PET polymer having $T_g$ in the range of about 75 to about 85° C.

Referring now to FIG. 1, an exemplary apparatus 100 is provided for imaging a non-metal substrate 120. It should be readily apparent to those of ordinary skill in the art that the apparatus depicted in FIG. 1 represents a generalized schematic illustration and that other components may be added or existing components may be removed or modified. Moreover, the apparatus may be implemented using software components, hardware components, or combinations thereof.

The apparatus 100 can include a transport mechanism 130 for supporting and transporting the non-metal substrate 120, a substrate heater 140, an electrographic print module 150, also referred to as an imager, typically containing a photoconductor, exposure system, and a development system, an image exposure device 160, a temperature maintenance device 170, a fuser 180 which may or may not include fuser rolls 185, and an output 190 for receiving a fused image product 195.

The transport mechanism 130 can include an endless belt, or other suitable transport mechanism to feed the non-metal substrate 120 to the fuser 180. Preferably, the transport mechanism 130 can accommodate either a stiff or a flexible non-metal substrate. In certain aspects, the transport mechanism 130 can accommodate a non-metal substrate 120 in the form of a sheet, roll-to-roll material, web, tube, sleeve or the like. In addition, the transport mechanism 130 can include suction or vacuum to retain the non-metal substrate 120 in position throughout its transport in the apparatus 100.

The substrate heater 140 can include non-contact heating to heat the non-metal substrate 120 to a predetermined temperature. The predetermined temperature is less than the glass transition temperature of the non-metal substrate. In certain aspects, the substrate heater 140 can include a top heater 142 and bottom heater 144, as shown, which can provide non-contact heating. It will be appreciated that a material specific heating device can be used to heat the non-metal substrate. By way of non-limiting examples, the non-metal substrate 120 can be heated by radiant heat, induction, RF, lamps, hot air, furnace, and other non-contact heating options known in the art. It will be appreciated that the substrate heater 140 can be selectively implemented according to a type of non-metal substrate 120 and/or toner composition. In other words, the substrate heater 140 will not need to be used in all instances. For example, a required fusing temperature can determine use or non-use of the substrate heater 140.

The non-metal substrate 120 can include a front surface 122 and a back side 124. The non-metal substrate 120 can include a flexible or rigid material. The non-metal substrate 120 can further include a heat sensitive material such as a heat sensitive film. The heat sensitive film can include plastic, such as polypropylene, polyethylene, or the like. In particular, the non-metal substrate can be label material, and in particular: Polyvinyl Chloride (PVC), Polypropylene Terephthalate Glycol (PETG), Oriented Polypropylene (OPP), Kimdura® Tyvek, or other synthetic papers, Polyethylene (PE), Polypropylene (PP), Polystyrene (PS), High Density Polyethylene (HDPE).

The non-metal substrate 120 can include a web, such as a roll-to-roll material. The non-metal substrate 120 can further include a sleeve, tube or similar non-metal substrate.

The imager 150 can apply a toner image 152 to the upper surface 122 of the non-metal substrate 120. The imager 150 can include an operating system for receiving image data; the corresponding toner image 152 transmitted to the non-metal substrate 120 using toner deposition components as known in the art. The toner image 152 can be applied from the imager 150 to the non-metal substrate film 120. Typically, when the non-metal substrate film 120 is in the form of a web of a sleeve or a tube, the web is under tension and can become elongated (e.g. stretched). Accordingly, the applied toner image 152 can be enlarged and elongated to compensate for shrinkage of the web or label stock during fusing, and after application to a labeled product.

The toner image 152 can include a toner composition suitable for use in connection with the non-metal substrate 120. The toner composition can include an IR absorber to a degree suitable for generating a predetermined amount of heat within the toner composition. The heat generated in the toner composition, via the IR absorbing dye, can produce a temperature in the toner composition less than a glass transition temperature (e.g. fusing temperature) of the toner composition and less than a glass transition temperature of the non-metal substrate so as to avoid damaging the non-metal substrate due to heating of IR absorbers in the toner composition.

The toner composition can contain an IR absorbing dye. In certain aspects, the IR absorbing dye can include yellow dye. The dye can include a high-molecular-weight infrared (IR) absorbing dye suitable for PET, PC, and other engineering plastics. The dye can be suitable for applications requiring strong IR absorption, low haze, and high clarity such as PET reheat dye, security marking, laser marking and welding, and master batch identification. Further, the IR absorbing dye can include an IR absorbing dye made by ColorChem International Corp.™ of Atlanta, Ga.

The exposure device 160 can direct light 162 toward the toner composition 152 of the imaged non-metal substrate 120. Exposure can be from the back side 124 of the non-metal substrate 120 or from the front side using exposure device 161. In one embodiment, exposure from the back of the non-metal substrate heats the surface of the toner adjacent to the non-metal substrate with the infrared radiation. Light containing a sufficient amount of IR radiation can be used to preheat the toner composition 152 of the imaged non-metal substrate 120 prior to fusing the toner image to the transparent or translucent non-metal substrate. Absorption of light by the substrate is sufficiently low (e.g. <10%) and absorption of light by the toned image can be sufficiently high (>50%) that enough energy is absorbed by the toner image to fuse the image without damaging the substrate. IR exposure of the toner image can therefore pre-heat the toner image prior to fusing. Because the toner composition 152 can be directly pre-heated, substantial heating of the non-metal substrate 120 can be avoided. In one embodiment, the toner is preheated at a faster rate than the non-metal substrate. In another embodiment, pre-heating prevents distortion of the non-metal substrate during fusing by limiting a preheat temperature to less than a non-metal substrate distortion temperature. If an entirety of the non-metal substrate is evenly heated during pre-heating, this prevents distortion of the non-metal substrate at a fusing temperature required for the toner. Also, if an entirety of the non-metal substrate is substantially heated during pre-heating, this preheating prevents one or more fuser rollers from losing a significant portion of heat to the non-metal substrate. In an embodiment of the invention, a majority of the heating of the non-metal substrate occurs after preheating, and preheating can increases process speed. In summary, preheating avoids distortion of the non-metal substrate due to an uneven heating of the non-metal substrate upon fusing or from heating a significant portion of the non-metal substrate above the glass transition temperature of the non-metal substrate.

In certain aspects, the non-metal substrate 120 can incorporate IR absorbers therein. In other aspects, the non-metal substrate 120 can include an IR absorbing layer thereon. During IR radiation exposure, the IR absorbers within the substrate or the IR absorbing layer can also be exposed, thereby heating the substrate or IR absorbing substrate layer to a predetermined temperature.

The imaged non-metal substrate 120 including the pre-heated toner image 152 can be conveyed by the transport mechanism 130 to the fuser 180 via the maintenance heater 170. The maintenance heater 170 can use non-contact heating to heat the imaged non-metal substrate 120 to a predetermined temperature. In effect, the maintenance heater 170 can maintain a temperature of the pre-heated toner, as achieved at the exposure station, until reaching the fuser 180. Further, the maintenance heater 170 can heat the imaged non-metal substrate 120 to a substrate temperature $T_p$. The maintenance heater 170 can therefore warm the non-metal substrate 120 prior to the "fusing" step, to prevent the non-metal substrate from absorbing heat from the fuser 180, to allow the heat from the fusing step to be used to melt and fuse the toner, and to avoid buckling or distortion of the non-metal substrate 120 during fusing.

In certain aspects, the maintenance heater 170 can include a top heater 172 and bottom heater 174, as shown, which can provide non-contact heating. It will be appreciated that a material specific heating device can be used to heat the imaged non-metal substrate 120. By way of non-limiting examples, the non-metal substrate 120 can be heated by radiant heat, induction, RF, lamps, hot air, furnace, and other non-contact heating options known in the art. It will be appreciated that the maintenance heater 170 can be selectively implemented according to a type of non-metal substrate 120 and/or toner composition. In other words, the same design maintenance heater 170 will not need to be used in all instances. For example, a required fusing temperature can determine use or non-use of the maintenance heater 170.

The fusing device 180 can fix the image created by the toner to the non-metal substrate 120, without damaging the non-metal substrate.

The fusing device 180 can include non-contact fusing components, as is well known to those skilled in the art. In non-contact fusing, heated rollers of the fuser do not contact the substrate. In certain aspects, fusing energy can be applied by a lamp, flash, or laser. Preferably, the fusing energy is applied through the receiver, to heat an interface between the toner and the receiver.

In certain aspects, the fusing device 180 can include contact fusing components 185 as also known in the art. In contact fusing, pressure sensitive rollers and heated rollers are in pressure contact with one another, the substrate passing therebetween.

Fusing can further be accomplished at the fusing device 180 with both temperature and pressure as also known in the art. In any of the types of fusers selected, the fusing device 180 can only heat the non-metal substrate 120 to an average bulk temperature less than a glass transition temperature of the non-metal substrate. Further, the imaged and pre-heated non-metal substrate 120 can be heated to a non-metal substrate temperature $T_F$ which is greater than $T_p$. The average $T_F$ of the bulk of the substrate after fusing, $T_b$, is less than the glass transition temperature $T_g$ of the non-metal substrate 120. However, the surface temperature of the substrate $T_s$ can be greater than $T_g$ of the substrate during and immediately after fusing of the toner composition onto the substrate.

Exemplary glass transition temperatures are provided in Table 1, below.

TABLE 1

| Polymer | $T_g$ (° C.) |
|---|---|
| Polyethylene (LDPE) | −105 or −30 |
| Tyre Rubber | −72 |
| Polypropylene (atactic) | −20 |
| Poly(vinyl acetate) (PVAc) | 28 |
| Polyethylene terephthalate (PET) | 69 |
| Poly(vinyl alcohol) (PVA) | 85 |
| Poly(vinyl chloride) (PVC) | 81 |
| Polystyrene | 95 |
| Polypropylene (isotactic) | 0 |
| Poly-3-hydroxybutyrate (PHB) | 15 |
| Poly(methylmethacrylate) (atactic) | 105 |
| Poly(carbonate) | 145 |
| Chalcogenide AsGeSeTe | 245 |

TABLE 1-continued

| Polymer | $T_g$ (° C.) |
|---|---|
| ZBLAN | 235 |
| Tellurite | 279 |
| Avatrel: Polynorbornene | 215 |
| Fluoroaluminate | 400 |
| Soda-lime glass | 520-600 |
| Fused quartz | 1175 |

As such, at the maintenance heater 170, a temperature of the pre-heated toner 152 can be maintained, and a temperature of the non-metal substrate 120 can be raised without yet fusing the toner image thereto, thereby enabling control of a temperature at the fusing device 180 to within a small fluctuation. The fusing device 180 can therefore fuse the toner composition to the non-metal substrate 120, without buckling or distortion of the non-metal substrate and allowing for high speed fusing of the non-metal substrate 120.

The fusing device 180 can output a fused imaged product 195 into an output device 190. The output device 190 can include a tray in the case of sheet feeding. The output device 190 can include a take up roll or the like in the case of a roll-to-roll or web type material. The output device 190 can further supply a subsequent processing device (not shown).

Figure 2:
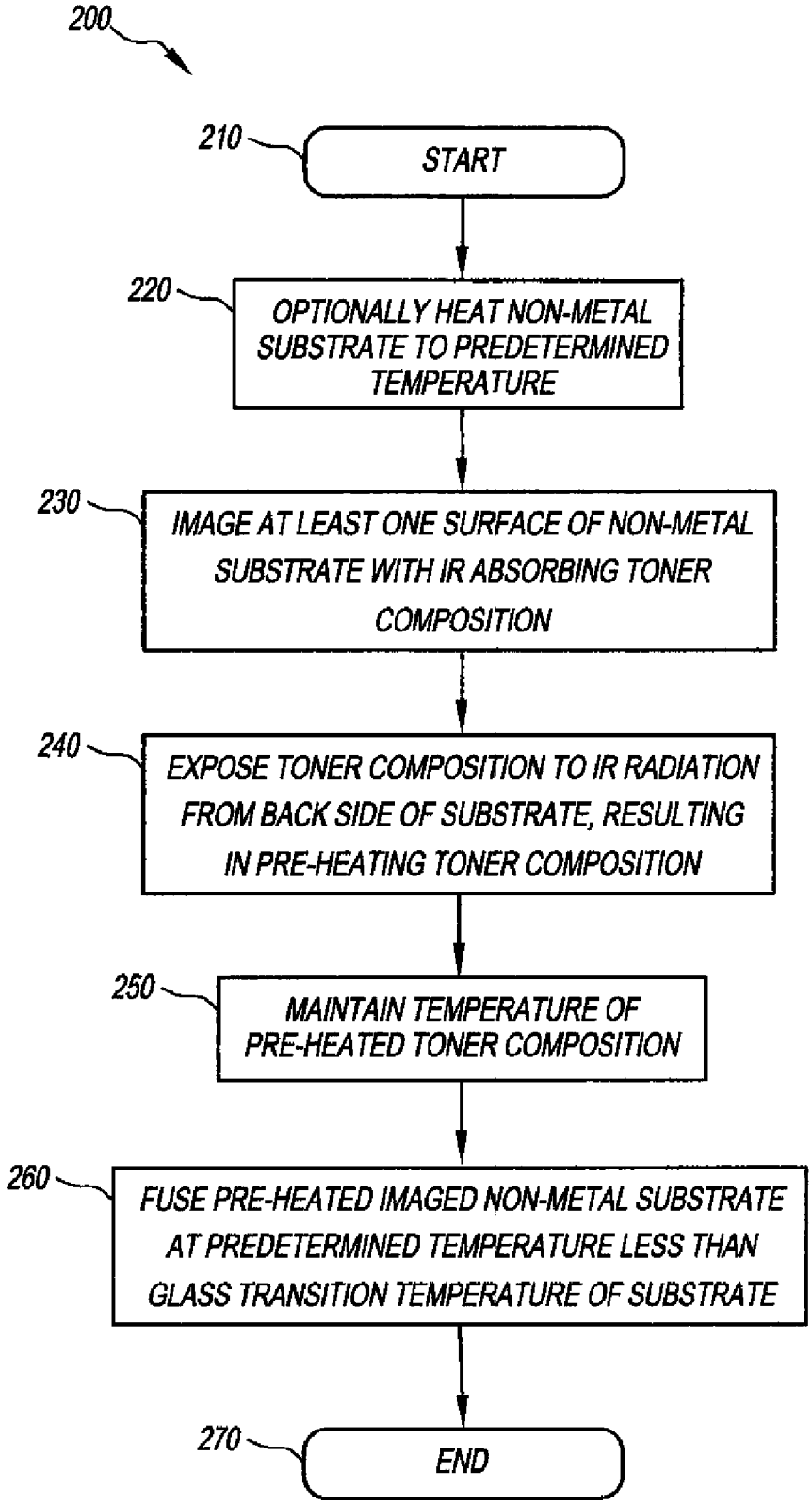
FIG. 2 is a flow chart depicting an exemplary method in accordance with this invention.

Referring to FIG. 2, an exemplary method 200 is provided for managing a non-metal substrate in the imaging apparatus of FIG. 1. It should be readily apparent to those of ordinary skill in the art that the method depicted in FIG. 2 represents a generalized schematic illustration and that other steps may be added or existing steps may be removed or modified. Moreover, the method may be implemented using software components, hardware components, or combinations thereof.

The method 200 can begin at 210.

At 220, a non-metal substrate can be optionally heated by a substrate heater 140 to a predetermined temperature $T_p$. It will be appreciated that a substrate heater 140 can be selectively implemented according to a type of non-metal substrate 120 and/or toner composition. In other words, the substrate heater 140 will not need to be used in all instances. For example, a required fusing temperature can determine use or non-use of the substrate heater 140.

At 230, at least one surface of the non-metal substrate can be imaged with a toner composition. The toner composition can include known toner compositions suitable for use on a non-metal substrate. The toner composition can further include IR absorbers. Exemplary non-metal substrates can include flexible, heat sensitive films. The heat sensitive films can include plastic, such as polypropylene and polyethylene. Further, the non-metal substrate can be in the form of a web, roll-to-roll material, tube, sleeve, or other flexible non-metal substrate.

At 240, the toner composition can be exposed to IR radiation through the non-metal substrate. Exposing the toner composition can excite the IR absorbers and thereby pre-heat the toner composition to a temperature less than a glass transition temperature $T_g$ of the toner composition or greater than a glass transition temperature $T_g$ of the toner composition. In either case, the average temperature of the substrate $T_b$ is less than the glass transition temperature of the substrate $T_g$. The preheating can prevent distortion of the non-metal substrate during a subsequent fusing.

At 250, a temperature maintenance device 170 can maintain a temperature of the pre-heated toner composition and raise a temperature of the non-metal substrate prior to fusing. Subsequent to 250, the average temperature of the substrate $T_b$ is less than the glass transition temperature of the substrate $T_g$ It will be appreciated that the maintenance heater 170 can be selectively implemented according to a type of non-metal substrate 120 and/or toner composition. In other words, the maintenance heater 170 will not need to be used in all instances. For example, a required fusing temperature can determine use or non-use of the maintenance heater 170.

At 260, the pre-heated imaged non-metal substrate can be fused at a predetermined temperature so that the average temperature of the bulk of the substrate $T_b$ is less than a glass transition temperature of the substrate $T_g$. The surface temperature of the substrate $T_s$ can be greater than $T_g$ of the substrate.

The method can end at 270.

While the invention has been illustrated with respect to one or more exemplary embodiments, alterations and/or modifications can be made to the illustrated examples without departing from the spirit and scope of the appended claims. In particular, although the method has been described by examples, the steps of the method may be performed in a different order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, "one or more of A and B," means A alone, B alone, or A and B.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein.

The invention has been described in detail with particular reference to certain preferred embodiments thereof, but it will be understood that variations and modifications can be effected within the spirit and scope of the invention.

What is claimed is:

1. A method of preparing a non-metal substrate in an electrophotographic imaging apparatus, the method comprising:

imaging at least one surface of the non-metal substrate with a toner, the non-metal substrate being transparent or translucent;

exposing the toner through the substrate;

pre-heating the toner to a temperature greater than the non-metal substrate to form a pre-heated imaged non-metal substrate;

fusing the pre-heated imaged non-metal substrate so that an average temperature of a bulk of the non-metal substrate is less than or substantially equal to a glass transition temperature of the non-metal substrate.

2. A method of preparing a non-metal substrate in an electrophotographic imaging apparatus, the method comprising:

imaging at least one surface of a non-metal substrate with a toner;

exposing the non-metal substrate to infrared radiation on the back side of the non-metal substrate to pre-heat the non-metal substrate and to pre-heat the toner to a temperature greater than the non-metal substrate to form a pre-heated imaged non-metal substrate;

fusing the pre-heated imaged non-metal substrate so that an average temperature of a bulk of the non-metal substrate is less than or substantially equal to a glass transition temperature of the non-metal substrate.

* * * * *